US008397697B2

(12) United States Patent
Achleitner et al.

(10) Patent No.: US 8,397,697 B2
(45) Date of Patent: Mar. 19, 2013

(54) METHOD AND DEVICE FOR OPERATING AN INJECTION VALVE

(75) Inventors: Erwin Achleitner, Obertraubling (DE); Dirk Baranowski, Regensburg (DE); Franz Kunz, Neunkirchen am Brand (DE)

(73) Assignee: Continental Automotive GmbH, Hannover (DE)

( * ) Notice: Subject to any disclaimer, the term of this patent is extended or adjusted under 35 U.S.C. 154(b) by 624 days.

(21) Appl. No.: 12/663,869

(22) PCT Filed: Jun. 2, 2008

(86) PCT No.: PCT/EP2008/056738

§ 371 (c)(1),
(2), (4) Date: Apr. 19, 2010

(87) PCT Pub. No.: WO2008/151954

PCT Pub. Date: Dec. 18, 2008

(65) Prior Publication Data

US 2010/0192914 A1 Aug. 5, 2010

(51) Int. Cl.

| | |
|---|---|
| ***F02D 41/20*** | (2006.01) |
| *F02D 41/22* | (2006.01) |
| *F02M 51/00* | (2006.01) |

(52) U.S. Cl. ..... 123/478; 239/585.5

(58) Field of Classification Search ..... 123/478, 123/480, 472, 499; 239/585.5; 310/314, 310/315; 251/129.01

See application file for complete search history.

(56) References Cited

U.S. PATENT DOCUMENTS

| | | | | |
|---|---|---|---|---|
| 3,987,764 | A * | 10/1976 | Scofield | 123/483 |
| 4,774,624 | A | 9/1988 | Qualich | 361/159 |
| 5,861,746 | A | 1/1999 | Ensten | 324/207.16 |
| 6,486,587 | B2 * | 11/2002 | Klenk et al. | 310/316.03 |
| 7,180,279 | B2 | 2/2007 | Novak | 323/283 |
| 2005/0047053 | A1 | 3/2005 | Meyer et al. | 361/139 |

FOREIGN PATENT DOCUMENTS

| | | |
|---|---|---|
| DE | 4130711 | 3/1993 |
| DE | 19645062 | 6/1997 |
| DE | 10138483 | 2/2003 |
| DE | 102004022947 | 12/2005 |
| DE | 10200505830 | 6/2007 |

OTHER PUBLICATIONS

International Search Report and Written Opinion for Application No. PCT/EP2008/056738 (11 pages), Nov. 4, 2008.

German Office Action for Application No. 10 2007 026 947.3 (3 pages), Nov. 28, 2007.

* cited by examiner

*Primary Examiner* — Hieu T Vo

(74) *Attorney, Agent, or Firm* — King & Spalding L.L.P.

(57) ABSTRACT

In a method and a device for operating an injection valve, a relevant time (t_ACT) is determined during a catch phase (PH_CATCH) when the electromagnetic actuator reaches a predetermined fraction value of the electric current, which value is smaller than a maximum current value, and a fraction of interval (T_FRAC) since the start of the respective catch phase (PH_CATCH) is determined depending thereon and the injection valve is diagnosed depending on the fraction of interval (T_FRAC) and the predetermined minimum and maximum threshold interval values (THD_T_MIN, THD_T_MAX).

20 Claims, 5 Drawing Sheets

METHOD AND DEVICE FOR OPERATING AN INJECTION VALVE

CROSS-REFERENCE TO RELATED APPLICATIONS

This application is a U.S. National Stage Application of International Application No. PCT/EP2008/056738 filed Jun. 2, 2008, which designates the United States of America, and claims priority to German Application No. 10 2007 026 947.3 filed Jun. 12, 2007, the contents of which are hereby incorporated by reference in their entirety.

TECHNICAL FIELD

The invention relates to a method and a device for operating an injection valve. Such injection valves are typically used for metering fuel or also for metering additional substances for processing exhaust gases of internal combustion engines.

BACKGROUND

Ever stricter regulations with regard to permissible pollutants from motor vehicles in which internal combustion engines are arranged make it necessary to keep the pollutant emissions as low as possible in the internal combustion engine. In this context it is a requirement to ensure an easily reproducible operation of the respective injection valve and to detect possible errors in good time. Component tolerances, operating time since commissioning of the injection valve and operating conditions of the injection valve in particular have an influence on the behavior of the injection valve in this connection.

SUMMARY

According to various embodiments, a method and a device for operating an injection valve can be created which each make reliable operation of the injection valve possible.

According to an embodiment, in a method for operating an injection valve comprising an electromagnetic actuator and a valve needle driven by said actuator, that in a closed position disables a metering of fluid and outside the closed position releases a metering of fluid, —A control process for the metering of fluid comprises a catch phase with a predetermined catch phase time and a subsequent hold phase, with the electromagnetic actuator having a boosted current value applied to it during the catch phase by comparison to the remainder of the catch phase and the hold phase, until a maximum current value is reached, —On reaching a predetermined fraction value of the current during the catch phase, that is less than the maximum current value, an assigned point in time is detected, and as a function of the said time, a fractional time interval since the beginning of the respective catch phase is determined and—A diagnosis of the injection valve is undertaken as a function of the fractional time interval and predetermined minimum and maximum threshold interval values.

According to a further embodiment, the catch phase can be adapted as a function of the fractional time interval. According to a further embodiment, the fractional time interval can be determined in a first temperature interval of a temperature relevant in conjunction with the control of the electromagnetic actuator. According to a further embodiment, the first temperature interval may be representative for a cold operation of the injection valve. According to a further embodiment, the fractional time interval can be determined in a second temperature interval of the temperature are relevant in conjunction with the control of the electromagnetic actuator, with the second temperature interval being representative for warm operation of the injection valve.

According to another embodiment, in a method for operating an injection valve comprising an electromagnetic actuator and a valve needle driven by said actuator, that in a closed position disables a metering of fluid and outside the closed position releases a metering of fluid, —A control process of the metering of fluid comprises a catch phase with predetermined catch phase time and a subsequent hold phase, with the electromagnetic actuator having a boosted current value applied to it during the catch phase compared to the remainder of the catch phase and the hold phase, until a maximum current value is reached, —On reaching a predetermined fractional time during the catch phase, with the fractional time being less than the catch phase time, an assigned fraction current value is detected and a diagnosis of the injection valve is undertaken as a function of the fraction current value and predetermined minimum and maximum current threshold values.

According to a further embodiment, an adaptation of the catch phase time can be undertaken as a function of the fraction current value. According to a further embodiment, the fraction current value can be determined in a first temperature interval of a temperature relevant in conjunction with the control of the electromagnetic actuator. According to a further embodiment, the first temperature interval may be representative for a cold operation of the injection valve. According to a further embodiment, the fraction current value can be determined in a second temperature interval of the temperature relevant in conjunction with the control of the electromagnetic actuator, with the second temperature interval being representative for a warm operation of the injection valve. According to a further embodiment, the temperature relevant in conjunction with the control of the electromagnetic actuator can be determined as a function of an actual value of an electrical current of a fluid pump that is assigned to the injection valve.

According to yet another embodiment, a device for operating an injection valve comprising an electromagnetic actuator and a valve needle driven by said actuator, that in a closed position disables a metering of fluid and outside the closed position releases a metering of fluid, is embodied—During a catch phase to apply a boosted voltage value to the electromagnetic actuator by comparison to the remainder of the catch phase and the hold phase, until a maximum current value is reached, with a control process for the metering of fluid including the catch phase with predetermined catch phase time and the subsequent hold phase, —On reaching a predetermined fraction value of the current during the catch phase, that is less than the maximum current value, to detect an assigned time and as a function of said time, to determine a fractional time since the beginning of the respective catch phase and—To carry out a diagnosis of the injection valve as a function of the fractional time interval and predetermined minimum and maximum threshold time values.

According to yet another embodiment, a device for operating an injection valve comprising an electromagnetic actuator and a valve needle driven by said actuator, that in a closed position disables a metering of fluid and outside the closed position releases a metering of fluid, is embodied—During a catch phase to apply a boosted voltage value to the electromagnetic actuator by comparison to the remainder of the catch phase and the hold phase, until a maximum current value is reached, with a control process for the metering of fluid including the catch phase with predetermined catch phase time and the subsequent hold phase, —On reaching a predetermined fraction value during the catch phase, with the fractional time being less than the catch phase time, to detect an assigned fraction current value and to carry out a diagnosis of the injection valve as a function of the fraction current value and predetermined minimum and maximum current threshold values.

BRIEF DESCRIPTION OF THE DRAWINGS

Exemplary embodiments are explained in greater detail below with reference to the schematic diagrams. The Figures show.

Elements of the same construction or functioning in the same way are labeled with the same reference symbols in all the figures.

DETAILED DESCRIPTION

Figure 1:
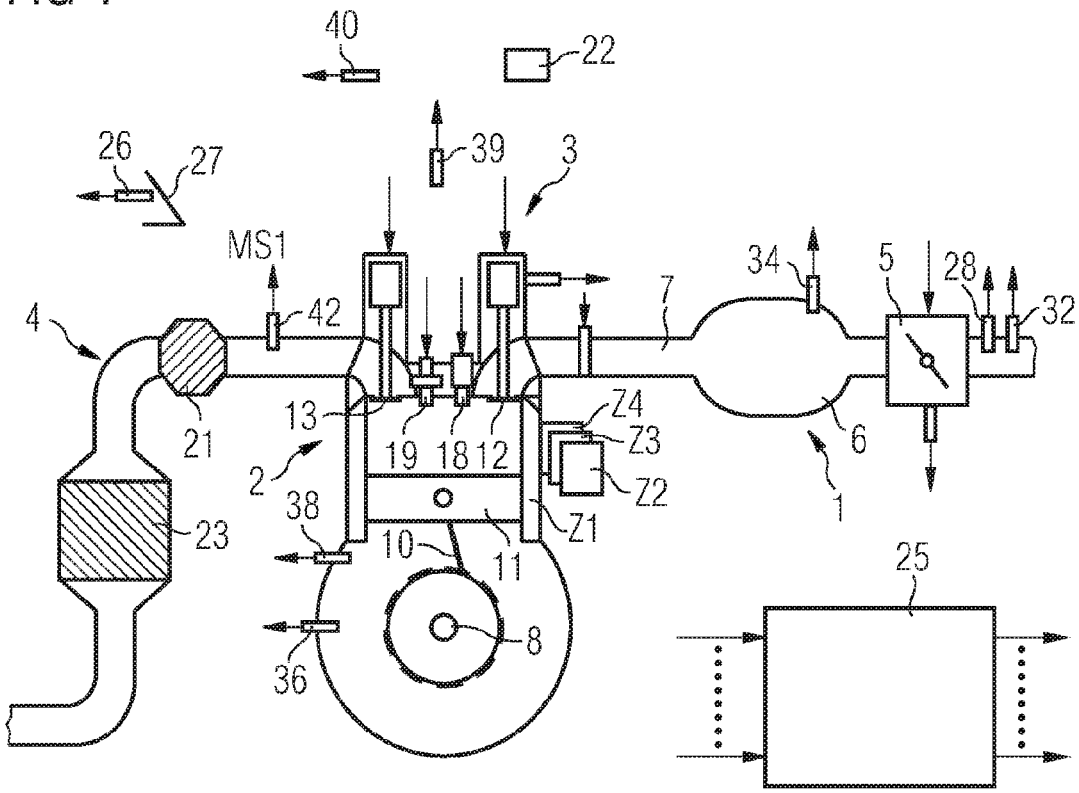
FIG. 1 an internal combustion engine with an injection valve and a control device, FIG. 2 a detailed view of the injection valve depicted in FIG. 1, FIG. 3 signal curves within the framework of a control process of the injection valve, FIG. 4 a first flow diagram of a first program and FIG. 5 a second flow diagram of a second program.

In accordance with one aspect, a method and a corresponding device for operating an injection valve comprise an electromagnetic actuator and a valve needle driven by the latter, which in a closed position disables a metering of fluid and outside the closed position releases a metering of fluid. A control process for the metering of fluid comprises a catch phase with a predetermined catch phase duration and a subsequent hold phase. During the catch phase an increased voltage is applied to the electromagnetic actuator compared to the remainder of the catch phase and the hold phase, until a maximum current value is reached, at which, on reaching a predetermined fraction value during the catch phase which is smaller than the maximum current value, an assigned time is detected. Depending on the assigned time, a fraction time interval since the beginning of the respective catch phase will be determined. A diagnosis of the injection valve is undertaken as a function of the fraction interval and predetermined minimum and maximum threshold interval values. An error in the area of the injection valve can thus be detected especially reliably and suitable error measures can then be initiated where necessary. A suitable choice of fraction value enables a very reliable diagnosis to be undertaken with a very low probability of diagnosis errors.

In particular a diagnosis can also be undertaken in this way with the very smallest amounts of fluid to be metered during a control process and it is not necessary to withdraw the diagnosis with such very small amounts.

The fraction value can especially advantageously amount to around 30 to 70 percent of the maximum current value during the catch phase, especially to around 50 percent.

In accordance with an embodiment, the fractional time interval will be adapted as a function of the catch phase duration. In this way influences which are of a size that does not effect the correct operation of the injection valve in an impermissible manner can be taken into account and an especially error-free diagnosis can thus be ensured. Such influences can typically be component tolerances, ageing effects or also other influences such as temperature influences for example. Thus an individual adaptation of the respective injection valve can be undertaken with the effect that an advantageously embodied injection valve adapted to said conditions can be reproducibly supplied even with an extremely small metered fuel amount.

By means of a further embodiment, the fractional time interval will be determined in a first temperature interval of a temperature relevant in conjunction with the control of the electromagnetic actuator. This makes an especially precise diagnosis possible and does so especially in conjunction with the adaptation of the catch phase duration. In this connection it is advantageous for the first temperature interval to be representative for cold operation of the injection valve.

It is also advantageous for the fractional time to be determined in a second temperature interval of the temperature relevant in conjunction with the control of the electromagnetic actuator, with the second temperature interval being representative for warm operation of the injection valve. In this way an extremely reliable diagnosis can be carried out and this can be done especially if an adaptation of the catch phase duration might also be performed.

In accordance with a second aspect, in a method and a corresponding device for operating the injection valve, an assigned fraction current value is detected on reaching a predetermined fractional time interval during the catch phase. The predetermined fractional time interval is smaller than the catch phase interval. A diagnosis of the injection valve is carried out as a function of the fraction current value and predetermined minimum and maximum current threshold values. In this way, especially with a suitable choice of the fractional time interval, an extremely reliable diagnosis with a very low probability of errors in the diagnosis can be carried out. The fractional time interval can especially advantageously amount to 30 to 70 percent of the catch phase interval, especially around 50 percent.

In accordance with an embodiment, an adaptation of the catch phase interval is carried out as a function of the fraction current value. In this way influences which, by virtue of their size, do not impermissibly affect the correct operation of the injection valve, can be taken into consideration. Such influences can for example be component tolerances, ageing effects or other influences such as temperature influences for example. Thus an individual adaptation of the respective injection valve can be undertaken with the effect that an advantageously embodied injection valve adapted to said conditions can be reproducibly supplied even with an extremely small metered fuel amount.

In accordance with a further embodiment, the fraction current value of will be determined in a first temperature interval of a temperature relevant in conjunction with the control of the electromagnetic actuator. This makes an especially precise diagnosis possible and does so especially in conjunction with the adaptation of the catch phase duration. In this context it is advantageous for the first temperature interval to be representative for cold operation of the injection valve.

In accordance with a further embodiment, the fraction current value is determined in a second temperature interval of the temperature relevant in conjunction with the control of the electromagnetic actuator, with the second temperature interval being representative for warm operation of the injection valve. In this way an extremely reliable diagnosis can be carried out and this can be done especially when an adaptation of the catch phase interval might have to be carried out.

In accordance with a further embodiment, the temperature relevant in connection with the control of the electromagnetic actuator is determined as a function of the actual value of an electrical current of the fluid pump which is assigned to the injection valve. In this way the temperature relevant for the control of the electromagnetic actuator can be determined in an especially simple manner and without the provision of additional sensor systems.

An internal combustion engine (FIG. 1) comprises an inlet tract 1, an engine block 2, a cylinder head 3 and an exhaust tract 4. The inlet tract 1 preferably comprises a throttle flap 5, also an accumulator 6 and an induction pipe 7 which is routed through to a cylinder Z1 to an inlet channel in the engine block 2. The engine block 2 further includes a crankshaft 8 which is coupled via a connecting rod 10 to the piston 11 of the cylinder Z1.

The cylinder head 3 comprises valve gear with a gas inlet valve 12 and a gas exhaust valve 13.

The cylinder head 3 further comprises an injection valve 18 and a spark plug 19. As an alternative the injection valve 18 can also be arranged in the induction tube 7.

Arranged in the exhaust tract 4 is a catalytic converter 21 which is preferably embodied as a three-way catalytic converter.

In addition a fluid pump 22 is provided in a fluid feed to the injection valve not shown in the diagram, with said pump especially being embodied as a high-pressure pump. The fluid pump includes an electrical actuator assigned to it with which its pump behavior can be controlled.

A control device 25 is provided to which sensors are assigned which detect different measurement variables and determine the value of the measurement variable in each case. Operating variables, as well as the measurement variables, also include variables derived therefrom. The control device 25 determines manipulated variables depending on a least one of the operating variables which are then converted into one or more signals for controlling the actuators by means of corresponding actuator drives. The control device 25 can also be referred to as the device for operating the injection valve.

The sensors are a pedal position sensor 26 which detects a position of a gas pedal 27, an air mass sensor 28 which detects an air mass flow upstream from the throttle flap 5, a first temperature sensor 32 which detects an induction air temperature, an induction pipe pressure sensor 34 which detects an induction pipe pressure in the accumulator 7, a crankshaft angle sensor 36 which detects a crankshaft angle to which a rotational speed is then assigned.

In addition a second temperature sensor 38 is provided which detects a coolant temperature. In addition a pressure sensor 39 is provided which detects a fluid pressure FUP, especially in a high-pressure reservoir of the fluid feed. Furthermore a third temperature sensor 40 is provided which detects a temperature, i.e. especially a fluid temperature in the fluid feed, i.e. especially in a high-pressure accumulator.

An exhaust gas probe 42 is provided, which is arranged upstream from or in the catalytic converter 21 and which detects a residual oxygen content of the exhaust gas and of which the measurement signal MS1 is characteristic for the air/fuel ratio in the combustion chamber of the cylinder Z1 and upstream from the exhaust gas probe before the oxidation of the fuel, referred to below as the air/fuel ratio in the cylinders Z1 to Z4.

Depending on the form of the embodiment, any given subset of the said sensors can be present or additional sensors can also be present.

The actuators are for example the throttle flap 5, the gas inlet and gas outlet valves 12, 13, the injection valve 18, the spark plug 19 or the fluid pump 22.

As well as the cylinder Z1, further cylinders Z1-Z4 are also provided to which the corresponding actuators and where necessary sensors are then assigned. This means that the internal combustion engine can have any given number of cylinders Z1-Z4.

The control device 25 preferably includes a memory for storage of programs and/or data. Furthermore a processing unit is provided which for example comprises a microprocessor in which the programs or parts of programs are processed during the operation of the internal combustion engine. In addition for example a control logic for undertaking control of injection valve can also be integrated into a specific integrated circuit, such as in an application-specific IC or a microcontroller for example.

Figure 2:
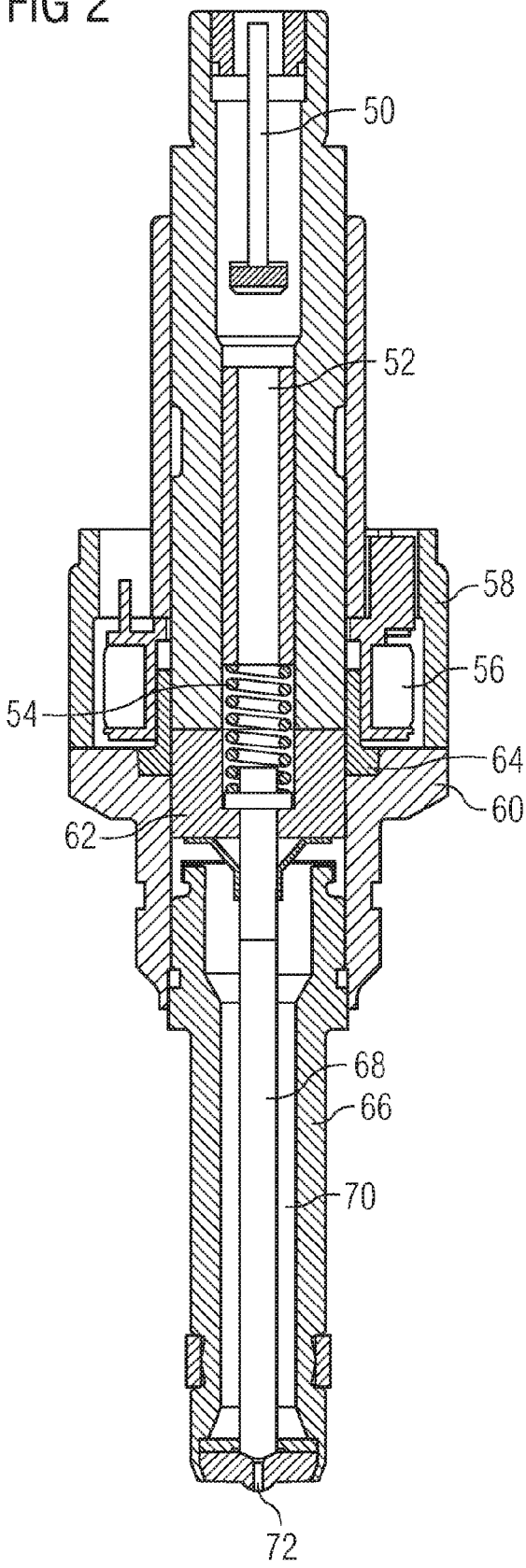

The injection valve 18 (FIG. 2) includes a fluid inlet body 50 with an inlet cutout 52, which is hydraulically coupled to the fluid feed and is especially supplied with fuel by the latter. The injection valve 18 also includes a reset spring 54. An electromagnetic actuator is provided which includes a coil 56, a magnetic housing 58, a valve body housing 60 and an armature 62 and basically also the fluid inlet body 50. In addition the electromagnetic actuator is also assigned a non-magnetic housing 64.

In addition the injection valve 18 includes a valve body 66 in which a valve needle 68 is arranged in a cutout 70. The valve needle 68 is coupled mechanically to the electromagnetic actuator, especially to the armature 62, so that in the closed position it disables a flow of fluid through an injection nozzle 72 and outside the closed position releases a flow of fluid through the injection nozzle 72. A lift of the valve needle 68 is provided by its position in the closed position and on the other hand its position—an open position—when the armature is in contact with the fluid inlet body 50. In this case the lift L of the valve needle 68 is at its maximum when the armature 62 is in contact with the fluid inlet body 50.

Figure 3:
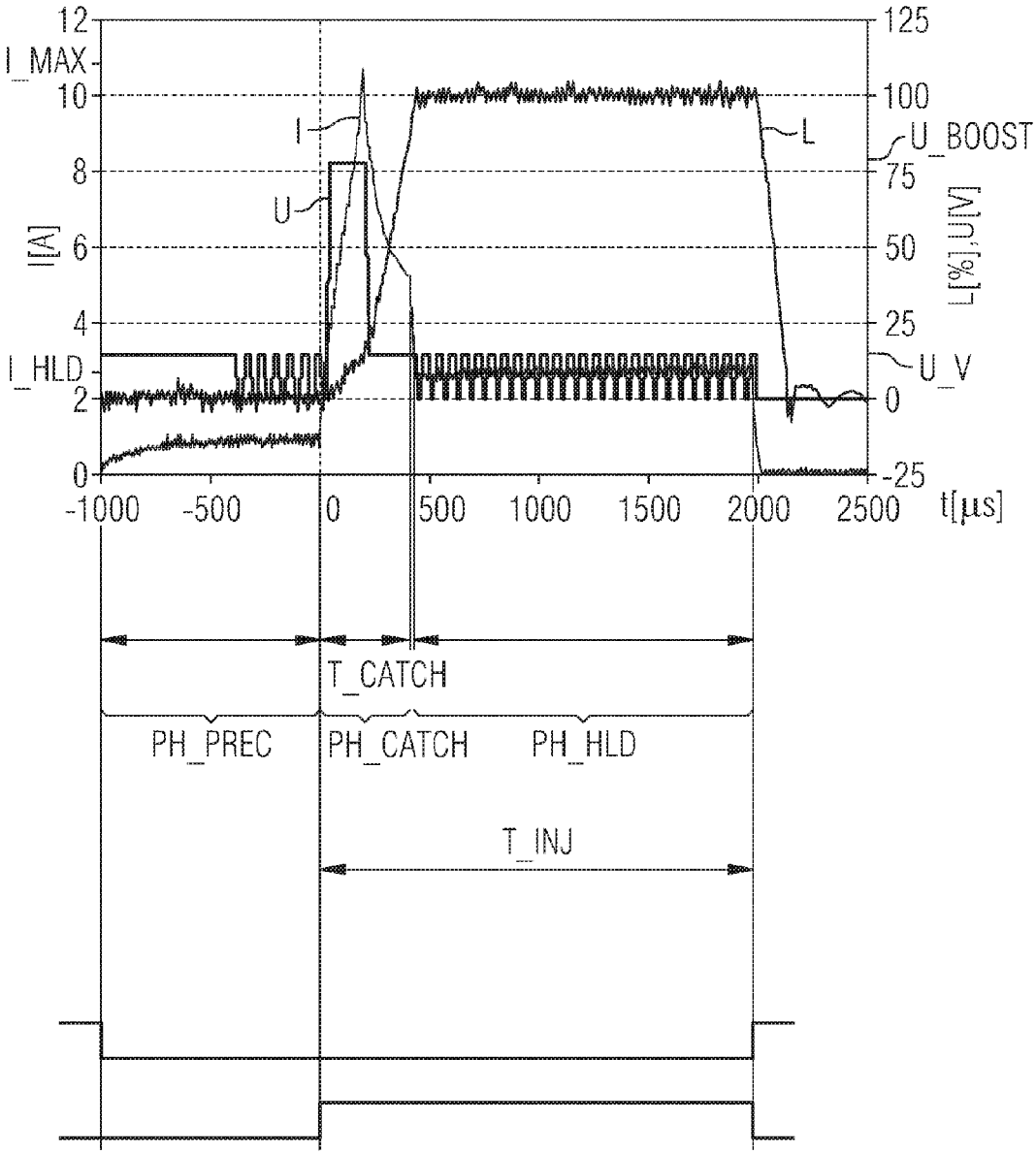

A control process for the metering of fluid is explained in greater detail below with a reference to the signal curves depicted in FIG. 3. The time t is plotted on the abscissa. Plotted on the ordinate on the left-hand side is a current I through the electromagnetic actuator in relation to its value units and plotted on the right-hand side are the percentage units in relation to the lift L and the value units in relation to the voltage U.

The voltage U is the voltage predetermined by the control device 25 falling via the electromagnetic actuator of the injection valve 18. In FIG. 3 a control process is shown by way of example.

In a preloading phase a low current value is predetermined which is greater than zero but on the other hand is also less than a holding current value I_HLD. In this way eddy current losses especially can be reduced and a reproducible opening of the valve needle 68 is made possible. The pre-charging phase PH_PREC is followed by a catch phase PH_CATCH during which the electromagnetic actuator has a boosted voltage value U_BOOST applied to it compared to the remainder of the catch phase and a subsequent hold phase, until a maximum current value I_MAX is reached. After the maximum current value I_MAX has been reached, the electromagnetic actuator has a supply voltage value U_V applied to it, which can for example be predetermined by an on-board network of a motor-vehicle in which the internal combustion engine is arranged and which can be subject to fluctuations. The application of the supply voltage value U_V to the electromagnetic actuator is then undertaken until a predetermined catch phase time T_CATCH elapses which is preferably predetermined as a function of a fuel pressure FUP and/or the supply voltage value U_V and which can be determined for example as a function of an engine map. Depending on when the maximum current value I_MAX is reached during the catch phase PH_CATCH or even is not reached, the boosted voltage value U_BOOST can also be predetermined up to a maximum of the entire catch phase PH_CATCH.

Subsequent to the catch phase PH_CATCH the control process includes the hold phase PH_HLD. Between the catch phase PH_CATCH and the hold phase PH_HLD a clamping phase can also be provided in which the current I is reduced suitably quickly to the hold current value I_HLD. This can typically be done by applying a boosted voltage value U_BOOST to the electromagnetic actuator of opposite polarity by comparison with the catch phase PH_CATCH.

After the conclusion of the hold phase PH_HLD the current I through the electromagnetic actuator is reduced to zero and the assigned lift again reduces to zero percent, i.e. in the closed position. Preferably the current I through the electromagnetic actuator is rapidly reduced to zero by an application to the electromagnetic actuator of the boosted voltage value U_BOOST of opposite polarity by comparison with the catch phase PH_CATCH. The catch phase PH_CATCH is predetermined so that the valve needle is to reach its open position.

An injection time T_INJ is given by the overall time of the catch phase PH_CATCH, the hold phase PH_HLD and if necessary the clamping phase.

A program for operating the injection valve is started in a step S1 (FIG. 4) and this is preferably done close to the time at which the internal combustion engine starts. Variables can be initialized in the step S1.

In a step S2 a check is made as to whether a current control process is presently in the catch phase PH_CATCH. If this is not the case processing is continued in a step S4 which represents a waiting state and during which other programs can also be processed if necessary. The processing is subsequently continued in a step S2, with the program pausing for a suitably short time in the wait state so that the steps of the program can be processed sufficiently often i.e. especially the program pauses in the step S4 for far less time than the duration of the control process and the catch phase time T_CATCH.

If on the other hand the condition of step S2 is fulfilled, processing is continued in a step S6 in which a check is made as to whether the current I through the electromagnetic actuator is greater than or equal to a predetermined fraction value I_G_FRAC. A predetermined fraction value I_G_FRAC is in this case predetermined so that there is a very high probability in any event of it being reached within the catch phase T_CATCH, i.e. especially with a faulty or fault-free injection valve. Preferably the predetermined fraction value I_G_FRAC as a value between approximately 30 to 70 percent, especially around 50 percent of the maximum current value I_MAX. The maximum current value can for example amount to between 6 and 15 Amperes.

If the condition of step S6 is not fulfilled, the program branches into step S4. The pausing of the program in the step S4 is especially selected in this context so that in the step S6 processing is undertaken frequently enough for the time at which the current exceeds the fraction value I_G_FRAC to be detected as accurately as possible.

If the condition of step S6 is fulfilled, processing will be continued at a step S8, in which the time t_ACT assigned to the fulfillment of the conditions of step S6 is detected and as a function of this a fractional time T_FRAC since the beginning of the respective catch phase PH_CATCH is determined.

In a step S10 a check is subsequently made as to whether the fractional time T_FRAC is greater than a minimum threshold time value THD_T_MIN and is less than a maximum threshold time value THD_T_MAX.

Preferably the minimum and maximum threshold time values are predetermined as a function of the fuel pressure FUP and/or the supply voltage value U_V and are stored in engine maps for example, depending on which they are then determined for executing step S10.

If the condition of step S10 is not fulfilled, then in a step S12 an error ERR is entered. Thus for example a faulty injection valve can be typically be diagnosed or a supply voltage error can be diagnosed by the error entry ERR. Alternately however a faulty injection valve 18 can be diagnosed only after multiple error entries. After step S12 processing will be continued in the step S4.

On the other hand, if the condition of step S10 is fulfilled, the processing is preferably continued in a step S14.

Alternately the processing can also be continued directly in the step S4. In the step S14 the catch phase time T_CATCH will be adapted as a function of the fractional time T_FRAC, the fuel pressure FUP and preferably the supply voltage value U_V. In this connection the minimum and maximum current values THD_I_MIN, THD_I_MAX are predetermined so that when the condition of step S10 is fulfilled an error-free operation of the injection valve is entirely possible and thus by a suitable adaptation of the catch phase time T_CATCH in the step S14, the energy for opening the injection valve can be predetermined as a constant independently of the temperatures and especially a diagnosis can also be applied to the smallest amounts of meterings of fluid.

After the processing of the step S14 processing will be continued in the step S4.

Figure 4:
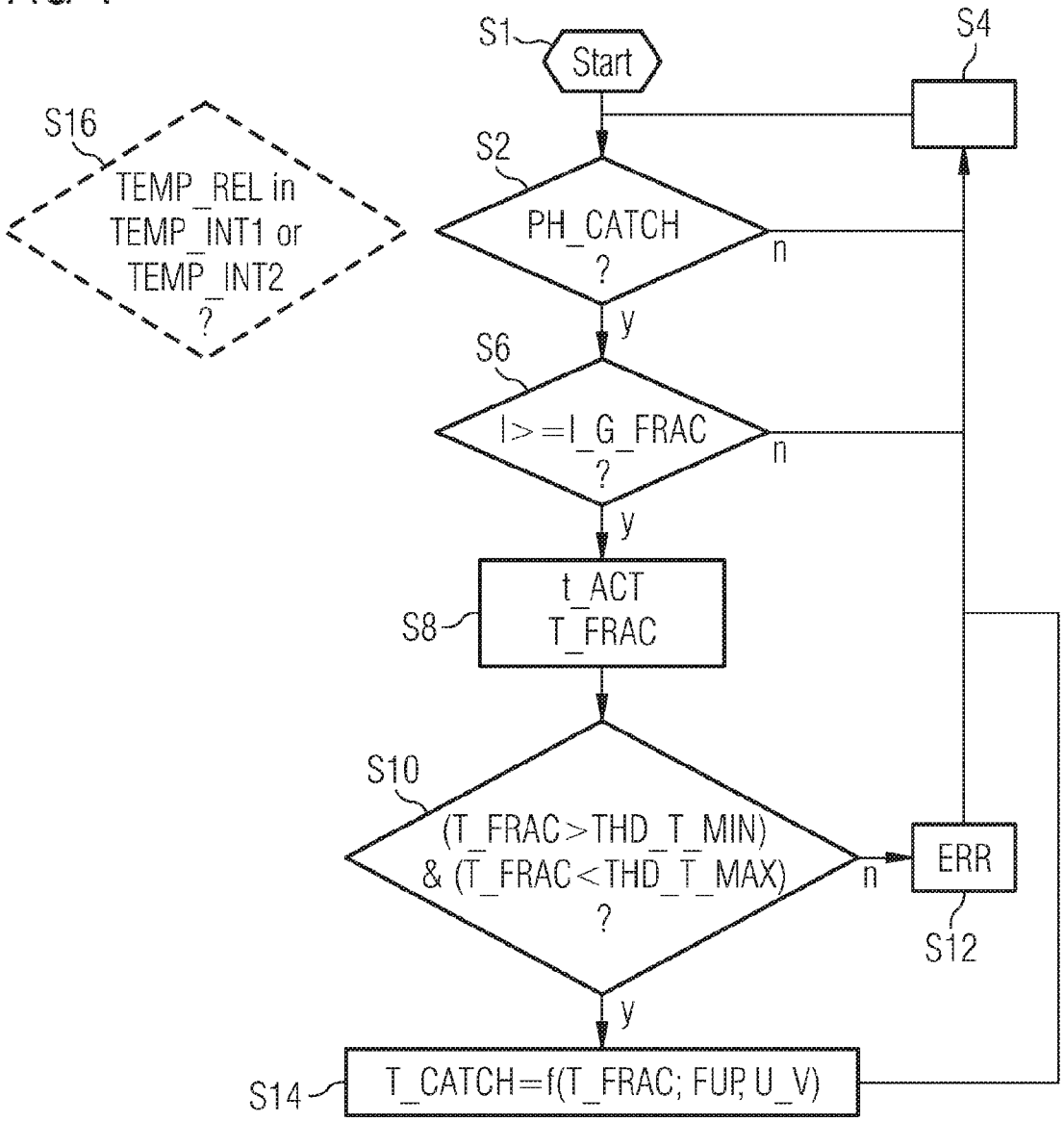

In a further embodiment of the program in accordance with FIG. 4 there is additional provision for a step S16 that will be processed after the step S1 and also after the step S4 and before the step S2. In this case a check is made in the step S16 as to whether a temperature relevant in conjunction with the control of the electromagnetic actuator TEMP_REL lies in a first temperature interval TEMP_INT1 or in a second temperature interval TEMP_INT2. In this case the first temperature interval TEMP_INT1 is preferably representative for cold operation of the injection valve, i.e. typically minus 30 to plus 30 degrees Celsius of the temperature of the coil 56. The second temperature interval is preferably representative for a warm operation of the injection valve, from 30 to 150 degrees Celsius for example.

In the step S16 for example it can thus only be checked whether the temperature relevant in connection with the control of the electromagnetic actuator TEMP_REL is in the first temperature interval or alternately whether it is in the second temperature interval TEMP_INT2 or whether it is assigned either to the first or the second temperature interval TEMP_INT1, TEMP_INT2.

If the condition of step S16 is fulfilled, processing is then continued in the step S2. If on the other hand the condition of step S16 is not fulfilled, a branch is made to the step S4. The provision of step S16 enables the diagnosis to be undertaken for either the first or the second or also the first and the second temperature interval TEMP_INT1, TEMP_INT2. In particular a corresponding adaptation of the catch phase time T_CATCH can also be undertaken in this way in these temperature intervals. Preferably the condition of step S16 is designed so that only the processing of step S14 is influenced by it, i.e. the adaptation is only undertaken if necessary when the condition of step S16 is fulfilled.

The temperature relevant for the control of the electromagnetic actuator TEMP_REL can be determined as a function of operating variables of the internal combustion engine. It can thus be determined for example as a function of the coolant temperature determined by means of the second temperature sensor 38 or also, if a third temperature sensor 40 is present, as a function of the fuel temperature determined by means of said sensor. In a simple manner and without the necessity for the presence of the third temperature sensor 40 the relevant temperature in connection with the control of the electromagnetic actuator TEMP_REL can be determined as a function of an actual value of the electrical current of the fluid pump 22 or as a function of another temperature model.

In this case the temperature relevant for the control of the electromagnetic actuator TEMP_REL can for example be representative for the temperature of the coil 56 of the electromagnetic actuator.

Preferably a predetermined temperature model is available, by means of which, depending on the actual value of the electrical current of the fluid pump 22, the temperature relevant for the control of the electromagnetic actuator TEMP_REL will be determined. In addition the temperature relevant in conjunction with the control of the electromagnetic actuator TEMP_REL can also be used for suitably adapted determination of the catch phase time T_CATCH and/or for determining correspondingly dependent predetermined minimum and maximum threshold time values THD_T_MIN, THD_T_MAX.

From the necessary adaptations in the step S14, which can also be referred to as the adaptation behavior, the current resistance after the final stage output can also be deduced, thus for example increased resistance for a plug connection for drift of the magnetic injection valve performance of a lifetime and temperature, especially temperature of a coil 56. Thus an improved diagnosis is possible and also a correction in the injection parameters.

Figure 5:
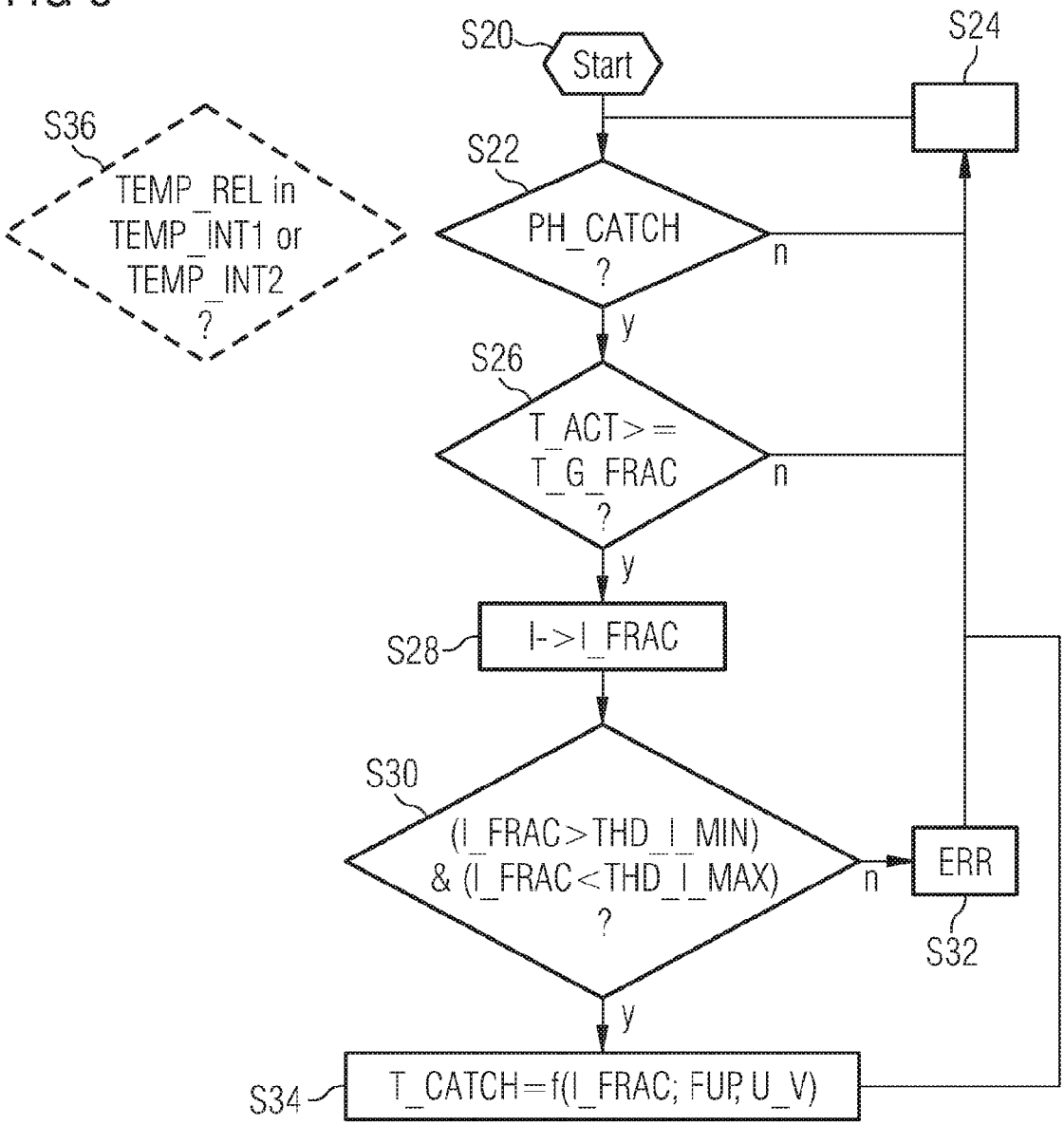

A second program which is explained in greater detail with reference to the flow diagram depicted in FIG. 5, differs from the program depicted FIG. 4 through the steps S26 to S30 and S34 which are modified by comparison with steps S6 to S10 and S14. Steps S20, S22, S24, S32 and S36 on the other hand correspond to the steps S1, S4, S12 and S16.

In the step S26 a check is made as to whether the actual time t_ACT related to the beginning of the respective catch phase PH_CATCH is greater than or equal to a predetermined fractional time T_G_FRAC. The predetermined fractional time T_G_FRAC is predetermined in this case such that it is less than the catch phase time T_CATCH and is actually markedly smaller than this time, thus for example between 30 and 70 percent of the catch phase time T_CATCH, for example around 50 percent of the catch phase time. If the predetermined fractional time T_G_FRAC amounts to exactly 50 percent of the catch phase time T_CATCH this can be determined especially simply by a simple bit shifting operation, by means of a timer which is also provided for the catch phase time T_CATCH.

If the condition of step S26 is not fulfilled, processing will be continued in the step S24. If on the other hand the condition of the step S26 is fulfilled, then in a step S28 the current I through the electromagnetic actuator is detected and is assigned to a fraction current value I_FRAC.

In a step S30 a check is subsequently made as to whether the fraction current value I_FRAC is greater than a predetermined minimum current threshold value THD_I_MIN and is less than a predetermined maximum current threshold value THD_I_MAX. The minimum and maximum current threshold values THD_I_MIN, THD_I_MAX are preferably predetermined at a function of the fuel pressure FUP and/or the supply voltage value U_V and will preferably be determined as a function of these values. They can however alternatively also be predefined as fixed values. If the condition of step S30 is not fulfilled, an error entry ERR is made in the step S32. The same also applies for the threshold time values THD_T_MIN, THD_T_MAX.

If the condition of step S30 is fulfilled on the other hand, processing can be continued in a step S34 and thereafter can then be continued in the step S24, it can however also be continued directly in the step S24.

In the step S34, as in step S14, the catch phase time T_CATCH is adapted, with the difference being that the adaptation is undertaken as a function of the fraction current value I_FRAC instead of as a function of the fractional time interval T_FRAC.

What is claimed is:

1. The device for operating an injection valve comprising an electromagnetic actuator and a valve needle driven by said actuator, which in a closed position disables a metering of fluid and outside the closed position releases a metering of fluid, wherein the device is operable to apply during a catch phase a boosted voltage value to the electromagnetic actuator by comparison to the remainder of the catch phase and the hold phase, until a maximum current value is reached, with a control process for the metering of fluid including the catch phase with predetermined catch phase time and the subsequent hold phase, on reaching a predetermined fraction value during the catch phase, with the fractional time being less than the catch phase time, to detect an assigned fraction current value and to carry out a diagnosis of the injection valve as a function of the fraction current value and predetermined minimum and maximum current threshold values.

2. The device according to claim 1, wherein an adaptation of the catch phase time is undertaken as a function of the fraction current value.

3. The device according to claim 1, wherein the fraction current value is determined in a first temperature interval of a temperature relevant in conjunction with the control of the electromagnetic actuator.

4. A device for operating an injection valve comprising an electromagnetic actuator and a valve needle driven by said actuator which in a closed position disables a metering of fluid and outside the closed position releases a metering of fluid, wherein the device is operable:

to apply during a catch phase a boosted voltage value to the electromagnetic actuator by comparison to the remainder of the catch phase and the hold phase, until a maximum current value is reached, with a control process for the metering of fluid including the catch phase with predetermined catch phase time and the subsequent hold phase, on reaching a predetermined fraction value of the current during the catch phase, which is less than the maximum current value, to detect an assigned time and as a function of said time, to determine a fractional time since the beginning of the respective catch phase, and to carry out a diagnosis of the injection valve as a function of the fractional time interval and predetermined minimum and maximum threshold time values.

5. The device according to claim 4, wherein the catch phase is adapted as a function of the fractional time interval.

6. The device according to claim 5, wherein the fractional time interval is determined in a second temperature interval of the temperature are relevant in conjunction with the control of the electromagnetic actuator, with the second temperature interval being representative for warm operation of the injection valve.

7. The device according to claim 4, wherein the fractional time interval is determined in a first temperature interval of a temperature relevant in conjunction with the control of the electromagnetic actuator.

8. The device according to claim 7, wherein the first temperature interval is representative for a cold operation of the injection valve.

9. A method for operating an injection valve comprising an electromagnetic actuator and a valve needle driven by said actuator which in a closed position disables a metering of fluid and outside the closed position releases a metering of fluid, the methods comprising the steps of:

controlling the metering of fluid by a catch phase with predetermined catch phase time and a subsequent hold phase, wherein the electromagnetic actuator having a boosted current value applied to it during the catch phase compared to the remainder of the catch phase and the hold phase, until a maximum current value is reached, on reaching a predetermined fractional time during the catch phase, with the fractional time being less than the catch phase time, detecting an assigned fraction current value and diagnosing the injection valve as a function of the fraction current value and predetermined minimum and maximum current threshold values.

10. The method according to claim 9, wherein an adaptation of the catch phase time is undertaken as a function of the fraction current value.

11. The method according to claim 9, wherein the fraction current value is determined in a first temperature interval of a temperature relevant in conjunction with the control of the electromagnetic actuator.

12. The method according to claim 11, wherein the fraction current value is determined in a second temperature interval of the temperature relevant in conjunction with the control of the electromagnetic actuator, with the second temperature interval being representative for a warm operation of the injection valve.

13. The method according to claim 11, wherein the temperature relevant in conjunction with the control of the electromagnetic actuator is determined as a function of an actual value of an electrical current of a fluid pump that is assigned to the injection valve.

14. The method according to claim 9, wherein the first temperature interval is representative for a cold operation of the injection valve.

15. A method for operating an injection valve comprising an electromagnetic actuator and a valve needle driven by said actuator which in a closed position disables a metering of fluid and outside the closed position releases a metering of fluid, comprising the steps of controlling the metering of fluid by a catch phase with a predetermined catch phase time and a subsequent hold phase, wherein the electromagnetic actuator having a boosted current value applied to it during the catch phase by comparison to the remainder of the catch phase and the hold phase, until a maximum current value is reached, On reaching a predetermined fraction value of the current during the catch phase, that is less than the maximum current value, detecting an assigned point in time, and as a function of the said time, determining a fractional time interval since the beginning of the respective catch phase, and diagnosing the injection valve as a function of the fractional time interval and predetermined minimum and maximum threshold interval values.

16. The method according to claim 15, wherein the catch phase is adapted as a function of the fractional time interval.

17. The method according to claim 15, wherein the fractional time interval is determined in a first temperature interval of a temperature relevant in conjunction with the control of the electromagnetic actuator.

18. The method according to claim 17, wherein the first temperature interval is representative for a cold operation of the injection valve.

19. The method according to claim 17, wherein the fractional time interval is determined in a second temperature interval of the temperature are relevant in conjunction with the control of the electromagnetic actuator, with the second temperature interval being representative for warm operation of the injection valve.

20. The method according to claim 17, wherein the temperature relevant in conjunction with the control of the electromagnetic actuator is determined as a function of an actual value of an electrical current of a fluid pump that is assigned to the injection valve.

* * * * *

UNITED STATES PATENT AND TRADEMARK OFFICE

CERTIFICATE OF CORRECTION

PATENT NO. : 8,397,697 B2
APPLICATION NO. : 12/663869
DATED : March 19, 2013
INVENTOR(S) : Erwin Achleitner et al.

It is certified that error appears in the above-identified patent and that said Letters Patent is hereby corrected as shown below:

Title Page
Insert Item --(30), Foreign Application Priority Data
Jun. 12, 2007 (DE) ..... 10 2007 026 947--

Signed and Sealed this
Fourteenth Day of May, 2013

Teresa Stanek Rea
*Acting Director of the United States Patent and Trademark Office*